US012433414B2

(12) United States Patent
Zhang et al.

(10) Patent No.: US 12,433,414 B2
(45) Date of Patent: Oct. 7, 2025

(54) ARMREST INSTALLATION STRUCTURE

(71) Applicant: SUNON TECHNOLOGY CO.,LTD, Zhejiang (CN)

(72) Inventors: Xujun Zhang, Zhejiang (CN); Hao Wu, Zhejiang (CN); Changjiang Liu, Zhejiang (CN); Xianping He, Zhejiang (CN)

(73) Assignee: SUNON TECHNOLOGY CO., LTD, Zhejiang (CN)

( * ) Notice: Subject to any disclaimer, the term of this patent is extended or adjusted under 35 U.S.C. 154(b) by 229 days.

(21) Appl. No.: 18/451,785

(22) Filed: Aug. 17, 2023

(65) Prior Publication Data

US 2024/0358158 A1 Oct. 31, 2024

(30) Foreign Application Priority Data

Apr. 28, 2023 (CN) ..... 202321015520.0

(51) Int. Cl.
*A47C 7/54* (2006.01)

(52) U.S. Cl.
CPC ..... *A47C 7/541* (2018.08); *A47C 7/546* (2013.01)

(58) Field of Classification Search
CPC ..... A47C 7/541; A47C 7/546
USPC ..... 297/411.28, 411.29, 411.44
See application file for complete search history.

(56) References Cited

U.S. PATENT DOCUMENTS 3,950,027 A * 4/1976 Wilson ..... A61G 15/10 297/411.27
6,250,715 B1 * 6/2001 Caruso ..... A47C 1/03 297/300.8
6,367,876 B2 * 4/2002 Caruso ..... A47C 1/03266 297/300.8
6,644,749 B2 * 11/2003 VanDeRiet ..... A47C 7/546 297/440.22
6,837,546 B2 * 1/2005 VanDeRiet ..... A47C 7/546 297/440.22
10,165,864 B1 * 1/2019 Su ..... A47C 1/03
10,441,082 B2 * 10/2019 Huang ..... A47C 7/543
10,463,153 B2 * 11/2019 Peterson ..... A47C 31/023
11,083,301 B2 * 8/2021 Deevers ..... A47C 1/0303
11,337,527 B2 * 5/2022 Chen ..... A47C 1/0307
11,344,128 B2 * 5/2022 Chen ..... A47C 7/541
11,375,820 B2 * 7/2022 Deevers ..... A47C 1/03255
11,439,239 B2 * 9/2022 Masunaga ..... A47C 7/40
11,517,112 B2 * 12/2022 Zhou ..... A47C 1/0303
11,800,935 B2 * 10/2023 Deevers ..... A47C 1/03255
(Continued)

*Primary Examiner* — Rodney B White
(74) *Attorney, Agent, or Firm* — JCIPRNET

(57) ABSTRACT

An armrest installation structure, includes a back frame, a pre-embedded sleeve, and an armrest body. The pre-embedded sleeve is fixedly installed in an inner cavity of the back frame; a side wall of the pre-embedded sleeve is provided with several deadbolt grooves provided along a length direction of the pre-embedded sleeve; the armrest body is internally provided with a deadbolt switchable between an unlocked state and a locked state, and a transmission assembly driving the deadbolt to switch between the two states; in the unlocked state, the deadbolt is stored into the armrest body and comes out of the deadbolt groove, and in the locked state, the deadbolt at least partially extends out of the armrest body and is plugged into any of the deadbolt grooves; and when the deadbolt is inserted into the deadbolt groove, the armrest body and the back frame keep relatively fixed.

8 Claims, 4 Drawing Sheets

(56) References Cited

U.S. PATENT DOCUMENTS

| | | | | |
|---|---|---|---|---|
| 12,161,234 | B2 * | 12/2024 | Deevers | A47C 7/541 |
| 2002/0003368 | A1 * | 1/2002 | VanDeRiet | A47C 3/04 297/300.5 |
| 2004/0000805 | A1 * | 1/2004 | VanDeRiet | A47C 7/546 297/300.1 |
| 2014/0361588 | A1 * | 12/2014 | Romero | A47C 1/03294 297/341 |
| 2015/0359338 | A1 * | 12/2015 | Romero | A47C 1/03261 297/341 |
| 2019/0351799 | A1 * | 11/2019 | Kim | A47C 7/541 |
| 2024/0008651 | A1 * | 1/2024 | Deevers | A47C 1/03255 |
| 2025/0017375 | A1 * | 1/2025 | Yun | A47C 1/0303 |
| 2025/0017376 | A1 * | 1/2025 | Yun | A47C 1/03 |

* cited by examiner

ARMREST INSTALLATION STRUCTURE

CROSS-REFERENCE TO RELATED APPLICATION

This application claims the priority benefit of China application serial no. 202321015520.0, filed on Apr. 28, 2023. The entirety of the above-mentioned patent application is hereby incorporated by reference herein and made a part of this specification.

BACKGROUND

Technical Field

The present invention relates to the technical field of chairs, in particular to an armrest installation structure.

Description of Related Art

At present, chairs on sale in the market generally have armrest structures. In general, armrests are fixed to a chair by bolts, and in an installation process, an auxiliary tool is needed for installation.

The armrests can be either integrated with the chair, or fixedly installed on the chair. When the chair is sold and packed, it is difficult to disassemble the armrests from the chair, leading to large chair size and inconvenience for chair packing. Even if the armrests can be disassembled from the chair, it is generally necessary to use an auxiliary tool for disassembly. When the chair is transported to a consumer, a specific tool needs to be used to install the armrests, resulting in increased complexity of armrest installation, which affects the experience of the consumer.

Therefore, how to design a structure facilitating the installation of armrests has become a technical problem that urgently needs to be solved by those skilled in the art.

SUMMARY

In order to solve at least one technical problem mentioned in the background art, it is an object of the present invention to provide an armrest installation structure to solve the problem that the armrests are inconvenient to install due to the use of an auxiliary tool.

To achieve the object above, the present invention provides the following technical solution:

an armrest installation structure comprises a back frame, a pre-embedded sleeve, and an armrest body, wherein the pre-embedded sleeve is fixedly installed in an inner cavity of the back frame; a side wall of the pre-embedded sleeve is provided with several deadbolt grooves provided along a length direction of the pre-embedded sleeve; the armrest body is internally provided with a deadbolt switchable between an unlocked state and a locked state, and a transmission assembly driving the deadbolt to switch between the two states; in the unlocked state, the deadbolt is stored into the armrest body and comes out of the deadbolt groove; and in the locked state, the deadbolt at least partially extends out of the armrest body and is plugged into any of the deadbolt grooves; and when the deadbolt is inserted into the deadbolt groove, the armrest body and the back frame keep relatively fixed.

Further, the transmission assembly comprises a transmission rod provided in an inner cavity of the armrest body; the transmission rod undergoes sliding connection along a length direction of the armrest body; a side wall of the armrest body is provided with a first notch communicated to the inner cavity of the armrest body; the deadbolt slides to plug into the first notch; the transmission rod is obliquely provided with a guide section; a bottom end of the guide section is tilted to one side of the first notch; the deadbolt is provided with a fastening groove fastened on an outer side of the guide section; and a side wall of the guide section abuts against an inner wall of the fastening groove.

Further, the transmission assembly further comprises a first compression spring; a top end of the first compression spring is fixedly connected to a bottom end of the transmission rod; and a bottom end of the first compression spring is fixedly connected to the armrest body.

Further, the transmission assembly further comprises a drive member pushing the transmission rod to slide along the armrest body; the drive member comprises a pushbutton switch, which comprises a pressing portion extending from outside of the armrest body, an pushing portion located in the inner cavity of the armrest body, and an articulated column located between the pressing portion and the pushing portion; the articulated column is articulated with the armrest body; and the pushing portion abuts against a top end of the transmission rod.

Further, a fixed seat is fixedly installed in the inner cavity of the armrest body; the fixed seat is provided with a socket groove allowing insertion of a lower end of the transmission rod; and the bottom end of the first compression spring is fixed on a bottom wall of the socket groove.

Further, the fixed seat is provided with a transversely-arranged sliding groove; the sliding groove is communicated to the socket groove; the deadbolt is installed in the sliding groove; and a side wall of the deadbolt is in sliding connection with an inner wall of the sliding groove.

Further, a side wall of the fixed seat is provided with an inwardly sunken storage groove, which is internally in sliding connection with a transversely-arranged anti-detachment buckle; the storage groove is internally provided with a second compression spring, one end of which is fixedly connected to a side wall of the storage groove, and the other end of which is fixedly connected to the anti-detachment buckle; an end of the anti-detachment buckle extends from the armrest body; and when the armrest body is at an upper limit position, an upper wall of the anti-detachment buckle abuts against a bottom wall of the pre-embedded sleeve.

Further, the side wall of the pre-embedded sleeve is provided with an anti-detachment groove with an opening facing downward; and when the armrest body is at the upper limit position, the anti-detachment buckle is plugged into the anti-detachment groove, and an upper wall of the anti-detachment buckle abuts against an upper wall of the anti-detachment groove.

Further, an outer wall of the back frame has a disassembly hole communicated to the inner cavity of the back frame; and the disassembly hole is located at the same height as the anti-detachment groove.

Compared with the prior art, the present invention has the following beneficial effects: the pre-embedded sleeve is installed inside the back frame and the deadbolt groove is provided in the side wall of the pre-embedded sleeve according to the present invention, such that when the armrest body is being installed, the deadbolt is controlled by the transmission assembly to switch between the locked state and the unlocked state, when the armrest body is installed, the deadbolt is withdrawn to the inside of the armrest body, and when the armrest body is in a suitable position, the deadbolt is switched to the locked state and then plugged into the inside of the deadbolt groove, thereby installing the armrest body rapidly;

when the deadbolt is withdrawn to the inside of the armrest body, the armrest body and the pre-embedded sleeve are unlocked, which is convenient for disassembling the armrest body from the back frame, thereby facilitating the packing of the chair and armrests, reducing the packaging volume of the chair, saving the packaging cost, and facilitating the transfer of the chair at the same time; and when the armrest body in the present invention is being installed, the armrest body can be installed rapidly without the use of an auxiliary tool for fixation, which increases the experience of a consumer.

DETAILED DESCRIPTION OF THE EMBODIMENTS

The technical solutions in the embodiments of the present invention will be described clearly and completely below. Obviously, the embodiments described are merely part of rather than all of the embodiments of the present invention. Based on the embodiments in the present invention, every other embodiment obtained by those of ordinary skills in the art without creative labor shall fall within the protection scope of the present invention.

This embodiment provides an armrest installation structure, mainly to achieve the rapid installation of armrests.

Figure 1:
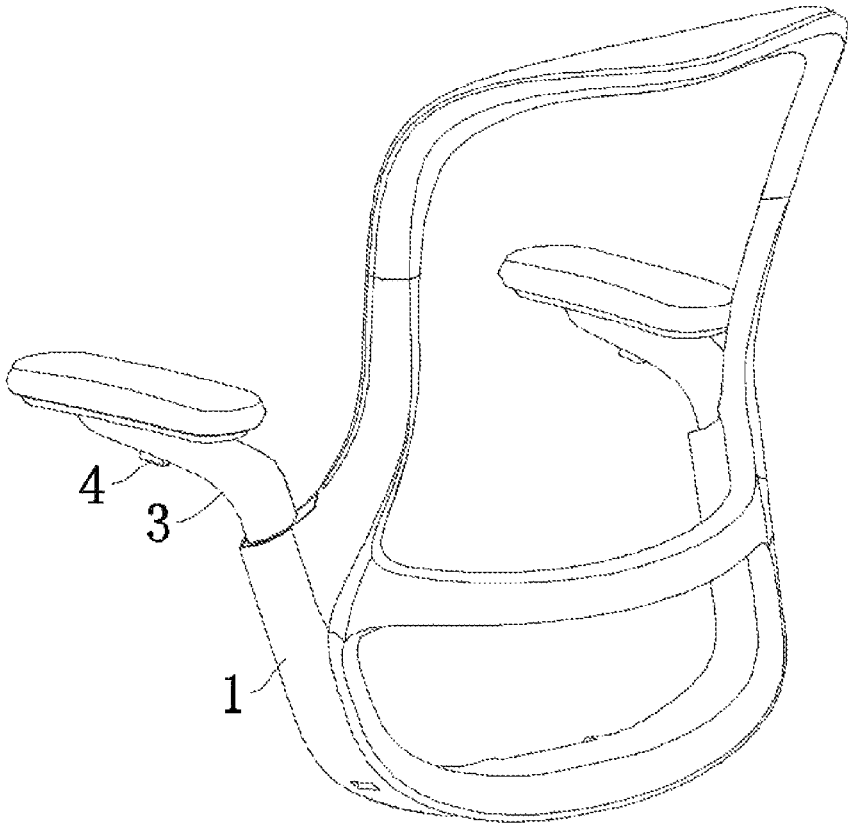
FIG. 1 is a schematic diagram of an armrest installation structure.

As shown in FIG. 1, a back frame 1 located on a chair body is included, wherein an armrest body 3 is installed inside the back frame 1.

Figure 2:
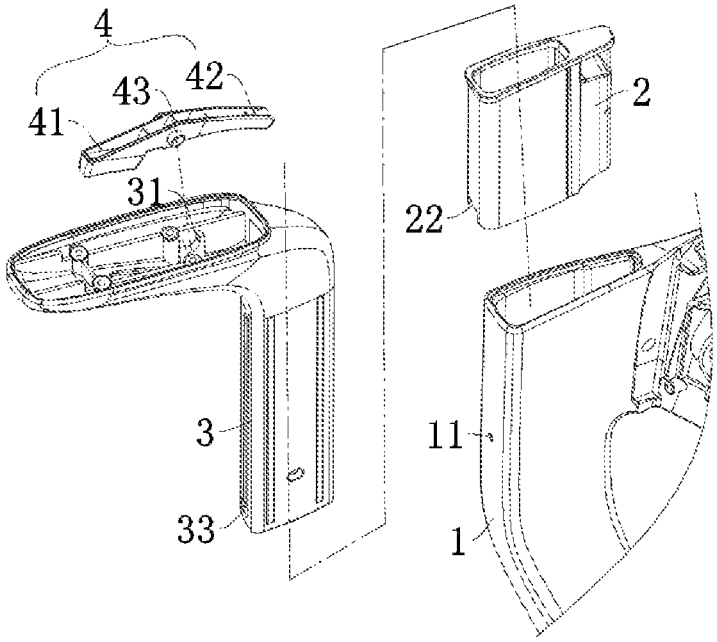
FIG. 2 is an exploded view of a first portion according to the present invention.
Figure 4:
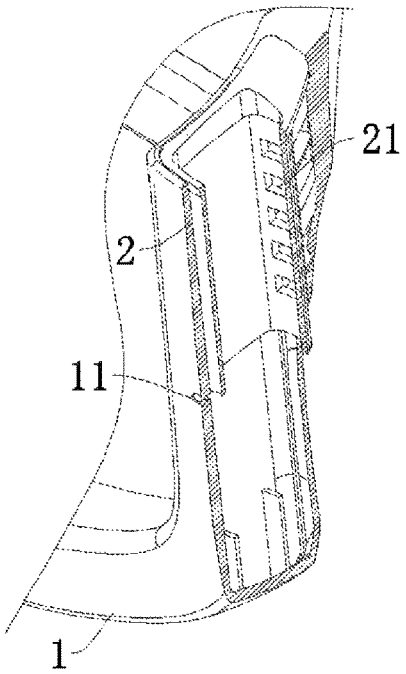
FIG. 4 is a sectional view of a pre-embedded sleeve according to the present invention.
Figure 5:
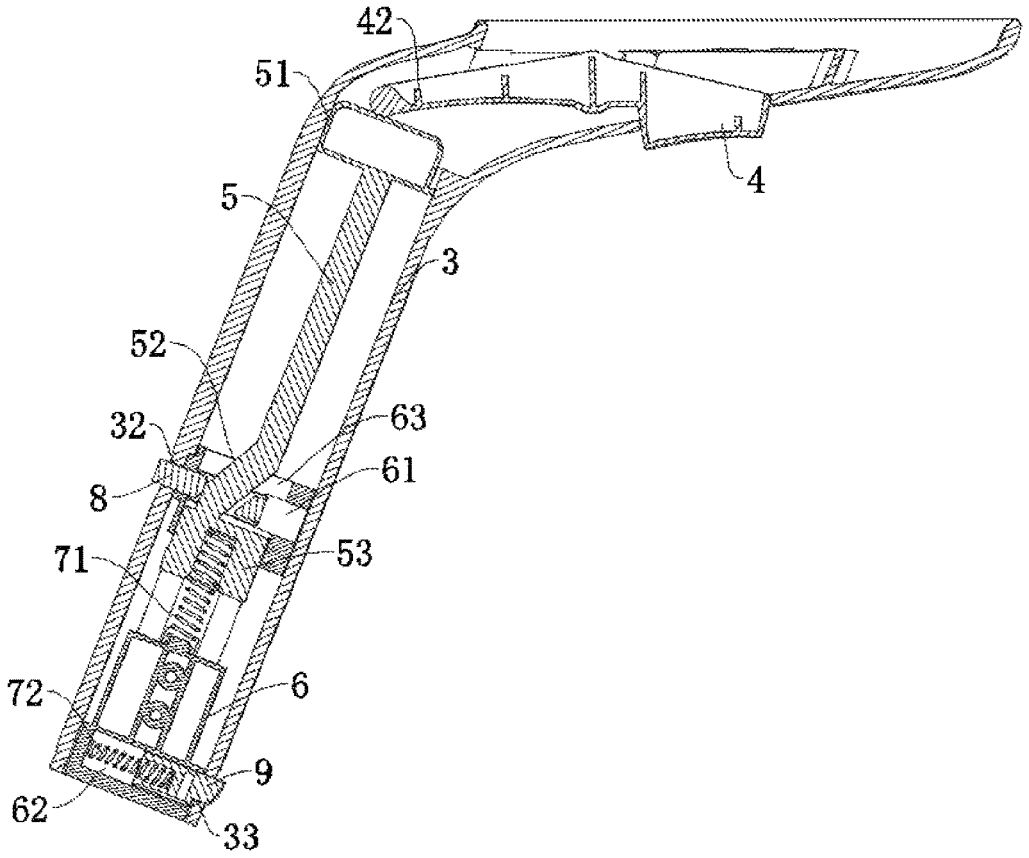
FIG. 5 is a sectional view of an armrest body.
Figure 6:
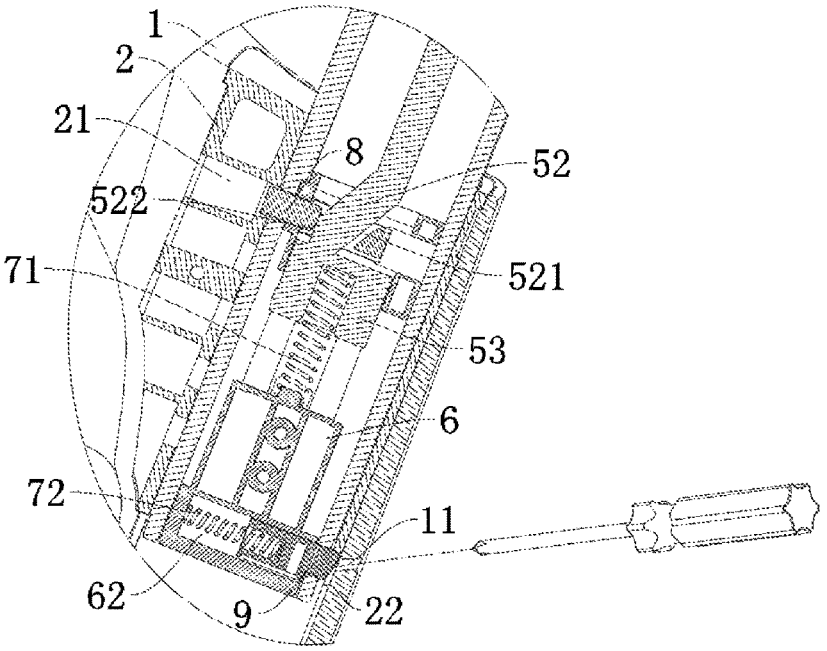
FIG. 6 is a partially-enlarged schematic structural diagram according to the present invention.

In order to facilitate the installation of the armrest body 3 and to make it possible to fix the armrest body 3 inside the back frame 1, in this embodiment, as shown in FIG. 2 and FIG. 4, an inner cavity of the back frame 1 is pre-embedded with a pre-embedded sleeve 2, which is fixed in the back frame 1 by means of a self-tapping screw. Specifically, an inner wall of the pre-embedded sleeve 2 is provided with several sets of deadbolt grooves 21 longitudinally provided along a body of the pre-embedded sleeve 2. As shown in FIG. 5 and FIG. 6, a deadbolt 8 switchable between an unlocked state and a locked state is installed inside the armrest body 3. In the unlocked state, the deadbolt 8 is stored into the armrest body 3 and detached from the inside of the deadbolt groove 21, so as to facilitate the plugging of the armrest body 3 into the inside of the pre-embedded sleeve 2. In the locked state, the deadbolt 8 partially extends out of the armrest body 3 and is then plugged into the inside of the deadbolt groove 21, thereby limiting the relative movement between the armrest body 3 and the pre-embedded sleeve 2 to achieve rapid installation of the armrest body 3.

In order make it possible to adjust the height of the armrest body 3, in this embodiment, as shown in FIG. 4 and FIG. 6, there are five deadbolt grooves 21 provided in the pre-embedded sleeve 2, with a distance of 12 mm between the adjacent two deadbolt grooves 21, such that a total stroke for which the armrest body 3 can be lifted is 60 mm. When the deadbolt 8 is plugged into different deadbolt grooves 21, the height of the armrest body 3 can thus be adjusted to adapt to people of different heights.

In order to install the deadbolt 8, in this embodiment, a side wall of the armrest body 3 is provided with a first notch 32 communicated to the inner cavity of the armrest body 3. The deadbolt 8 is plugged into the first notch 32 and is capable of transversely sliding.

Figure 3:
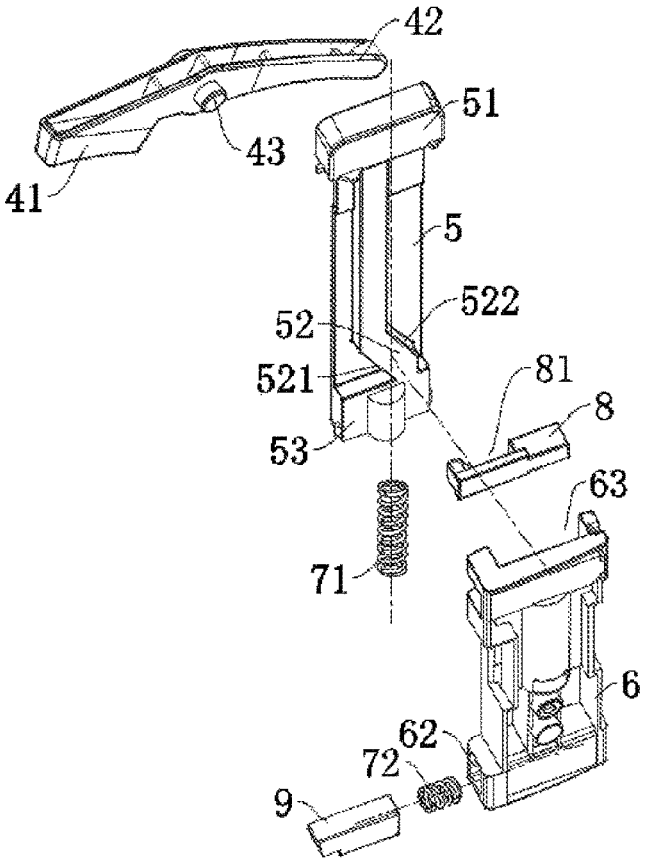
FIG. 3 is an exploded view of a second portion according to the present invention.
Figure 7:
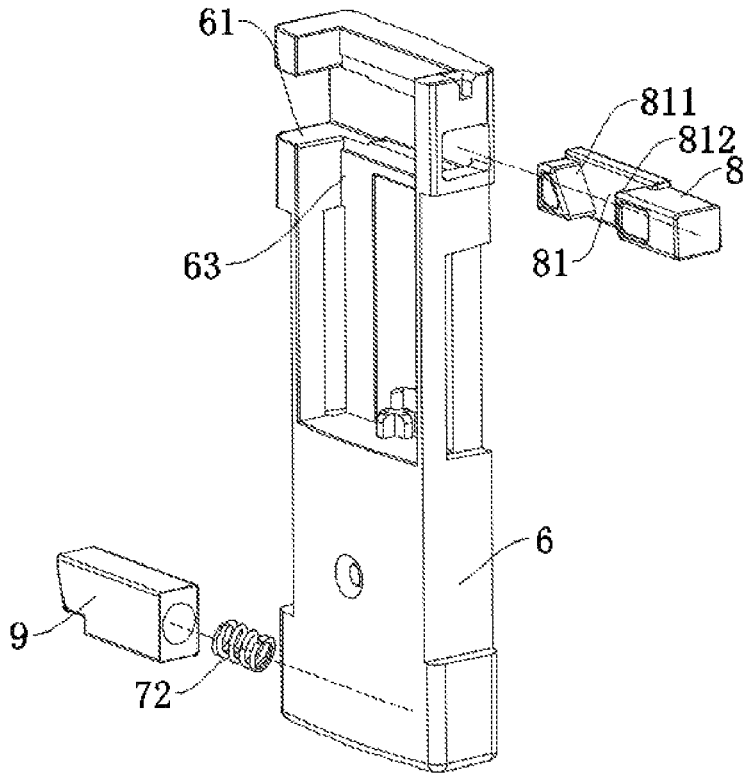
FIG. 7 is a schematic structural diagram of a fixed seat and a deadbolt.

In order to make it possible to switch the deadbolt 8 between the unlocked state and the locked state, in this embodiment, as shown in FIG. 3 and FIG. 5, the inner cavity of the armrest body 3 is provided with a transmission rod 5 that undergoes sliding connection along an axial direction of the armrest body 3, wherein the transmission rod 5 is provided with a guide section 52 for pushing the deadbolt 8. Specifically, as shown in FIG. 6, the guide section 52 is tilted from the top down, and a bottom end of the guide section 52 is tilted to one side of the first notch 32. As shown in FIG. 7, a side wall on one side of the deadbolt 8 is provided with a fastening groove 81 fastened on the outside of the guide section 52, wherein the guide section 52 is provided with a first guide surface 521 and a second guide surface 522, which are disposed obliquely. A side wall of the fastening groove 81 is provided with a first butting surface 811 and a second butting surface 812, wherein the first guide surface 521 abuts against the first butting surface 811, and the second guide surface 522 abuts against the second butting surface 812.

Specifically, the first guide surface 521 and the first butting surface 811 are located on a side away from the first notch 32, and the second guide surface 522 and the second butting surface 812 are located on a side close to the first notch 32.

With the above arrangement, when the transmission rod 5 slides from the top down, the first guide surface 521 on the guide section 52 abuts against the first butting surface 811, allowing the deadbolt 8 to slide into the inner cavity of the armrest body 3 and then to switch from the locked state to the unlocked state. When the transmission rod 5 slides from the bottom up, the second guide surface 522 of the guide section 52 then abuts against the second butting surface 812, pushing the deadbolt 8 to extend out of the outside of the armrest body 3, and then the deadbolt 8 can be pushed to the inside of the deadbolt groove 21, thereby locking the armrest body 3.

In order to make it possible to slide the transmission rod 5 from the bottom up to allow the armrest body 3 and the pre-embedded sleeve 2 to keep locked, in this embodiment, as shown in FIG. 3, FIG. 5 and FIG. 6, the inner cavity of the armrest body 3 is also provided with a first compression spring 71, wherein the bottom of the guide section 52 is provided with a connection section 53, one end of the first compression spring 71 is fixedly connected to the inner wall of the armrest body 3, and the other end of the first compression spring 71 is fixedly connected to the connection section 53. The transmission rod 5 can be pushed upwards by means of the first compression spring 71 at the bottom of the transmission rod 5, such that the deadbolt 8 on the armrest body 3 is in the locked state in a normal state, and the deadbolt 8 then partially extends out of the first notch 32.

In order to facilitate the downward pushing of the transmission rod 5, in this embodiment, as shown in FIG. 3 and FIG. 5, a pushbutton switch 4 is installed on the armrest body 3 located outside the back frame 1, wherein the pushbutton switch 4 includes a pressing portion 41 extending from the outside of the armrest body 3, and a pushing portion 42 located in the inner cavity of the armrest body 3, wherein the top of the transmission rod 5 is provided with a pushing section 51, and an end of the pushing portion 42 abuts against the pushing section 51.

In order to install the pushbutton switch 4, in this embodiment, as shown in FIG. 2, the armrest body 3 is provided with a clamping seat 31, and the middle of the pushbutton switch 4 is provided with an articulated column 43 articulated with the clamping seat 31, wherein the pushbutton switch 4 is capable of flipping around the articulated column 43.

Specifically, with the above arrangement, when the pressing portion 41 of the pushbutton switch 4 is pressed, the pushbutton switch 4 rotates around the articulated column 43, and the pushing portion 42 moves down, and then pushes the transmission rod 5 to move down. At this point, the guide section 52 on the transmission rod 5 retracts the deadbolt 8 into the armrest body 3, and the connection section 53 on the transmission rod 5 moves down to compress the first compression spring 71, releasing the locked state between the armrest body 3 and the pre-embedded sleeve 2. At this point, by pressing or lifting up the armrest body 3, the height of the armrest body 3 can be then adjusted. When the armrest body 3 is adjusted to a suitable height, the pressing on the pressing portion 41 is then released, and the first compression spring 71 pushes the transmission rod 5 up and back to an original state. At this point, the guide section 52 pushes the deadbolt 8 to the outside, so as to plug the deadbolt 8 into the inside of the deadbolt groove 21 of the corresponding height, and then continue to lock the armrest body 3 and the pre-embedded sleeve 2, thereby fixing the armrest body 3.

In order to facilitate the installation of the first compression spring 71, in this embodiment, as shown in FIG. 5 and FIG. 6, a fixed seat 6 is fixedly installed in the inner cavity of the armrest body 3 below the first notch 32. During installation, the fixed seat 6 is inserted inward from the bottom of the armrest body 3, and then is fixed with the armrest body 3 by means of set bolts. Specifically, as shown in FIG. 3, FIG. 5 and FIG. 7, a socket groove 63 allowing the insertion of the guide section 52 and the connection section 53 is provided above the fixed seat 6, wherein the connection section 53 is in sliding connection with the socket groove 63. A bottom end of the first compression spring 71 is fixed on a bottom wall of the socket groove 63, and a top end of the first compression spring 71 is fixed on the connection section 53.

The above first compression spring 71 and the connection section 53 on the transmission rod 5 are plugged into the socket groove 63 to form a sliding connection, which can also ensure the stable sliding of the transmission rod 5 in the inner cavity of the armrest body 3, thereby improving the sliding stability of the transmission rod 5.

In order to further improve the stability of the deadbolt 8 and ensure the stable transverse sliding of the deadbolt 8, in this embodiment, as shown in FIG. 7, the fixed seat 6 is provided with a transversely-arranged sliding groove 61. In the installed state, the sliding groove 61 is located at the same height as the first notch 32, the deadbolt 8 is installed inside the sliding groove 61, and the upper and lower walls of the deadbolt 8 butt against the upper and lower walls of the sliding groove 61, thereby ensuring the stable movement of the deadbolt 8.

When the armrest body 3 is being lifted up and down, in order to prevent the armrest body 3 from being detached from the back frame 1 due to excessive lifting, in this embodiment, as shown in FIG. 6 and FIG. 7, the bottom end of the armrest body 3 is also provided with an anti-detachment mechanism that restricts the detachment of the armrest body 3 from the back frame 1. Specifically, as shown in FIG. 6 and FIG. 7, the anti-detachment mechanism includes an anti-detachment groove 22, an anti-detachment buckle 9 and a second compression spring 72 pushing the anti-detachment buckle 9 to move. The anti-detachment groove 22 is provided on the bottom side wall of the pre-embedded sleeve 2 to form a notch with an opening facing downward; the bottom of the fixed seat 6 is provided with a transversely-arranged storage groove 62; and the side wall of the armrest body 3 is provided with a second notch 33 communicated to the storage groove 62. The anti-detachment buckle 9 is in sliding connection with the storage groove 62, with one end extending out of the armrest body 3 through the second notch 33. The second compression spring 72 is installed inside the storage groove 62, with one end fixedly connected to the anti-detachment buckle 9 and the other end fixedly connected to the side wall of the storage groove 62. In the installed state, the bottom of the armrest body 3 passes through the pre-embedded sleeve 2, and the end of the anti-detachment buckle 9 is pushed outward under the action of the second compression spring 72 and then abuts against the side wall of the inner cavity of the back frame 1.

During installation, the anti-detachment buckle 9 is located on the lower side of the pre-embedded sleeve 2. Therefore, when the armrest body 3 rises to the highest position, the anti-detachment buckle 9 is plugged into the anti-detachment groove 22 and then abuts against the upper wall of the anti-detachment groove 22, thereby restricting the armrest body 3 from continuing to move upward, such that the armrest body 3 in the installed state can be prevented from being detached from the back frame 1.

In order to make it possible to disassemble the armrest body 3 from the back frame 1, in this embodiment, as shown in FIG. 2 and FIG. 6, the outer wall of the back frame 1 is provided with a disassembly hole 11 communicated to the inner cavity of the back frame 1, wherein the height position of the disassembly hole 11 corresponds to the height of the anti-detachment groove 22 in the pre-embedded sleeve 2, and the disassembly hole 11 directly faces the anti-detachment groove 22. At this point, a rod-like object is plugged into the disassembly hole 11, and the anti-detachment buckle 9 is pushed to the inside of the storage groove 62, such that the second compression spring 72 is compressed. The anti-detachment buckle 9 is pushed to the inside of the storage slot 62 to eliminate the butting between the anti-detachment buckle 9 and the upper wall of the anti-detachment groove 22. At this point, by releasing the locked state between the deadbolt 8 and the deadbolt groove 21 by means of the pushbutton switch 4, the armrest body 3 is lifted up, and then can be further disassembled from the back frame 1.

It is worth noting here that, when a chair is on sale, the pre-embedded sleeve 2 is pre-installed inside the back frame 1, and the fixed seat 6, the anti-detachment structure, the pushbutton switch 4, the deadbolt 8 and the transmission rod 5 are pre-installed inside the armrest body 3. After a consumer receives the chair, the installation of the armrest body 3 can be completed as follows: the anti-detachment buckle 9 is pressed to compress the second compression spring 72, such that the anti-detachment buckle 9 is stored into the storage groove 62; then, the lower end of the armrest body 3 is inserted into the pre-embedded sleeve 2 and pressed downwards, while the pushbutton switch 4 is pressed to retract the deadbolt 8 into the armrest body 3 by means of the transmission rod 5, so as to prevent the deadbolt 8 from interfering with the installation of the armrest body 3 when the armrest body 3 is inserted into the back frame; after the anti-detachment buckle 9 continuously moves down to the bottom of the pre-embedded sleeve 2, the pre-embedded sleeve 2 releases the limitation to the anti-detachment buckle 9, which is pushed outwards under the action of the second compression spring 72, such that the end of the anti-detachment buckle 9 abuts against the side wall of the inner cavity of the back frame 1; when the armrest body 3 is adjusted to a suitable height, the pressing on the pushbutton switch 4 is released, and the deadbolt 8 then extends out of the armrest body 5 under the action of the transmission rod 5, and then is plugged into the deadbolt groove 21, thereby fixing the armrest body 3.

In this embodiment, since the pushbutton switch 4 is located on the armrest body 3 outside the back frame 1, the height of the armrest body 3 can be adjusted simply by pressing the pushbutton switch 4, and the armrest body 3 is easy and convenient to adjust in height, and is convenient for people to use.

What is claimed is:

1. An armrest installation structure, comprising a back frame, a pre-embedded sleeve, and an armrest body, wherein the pre-embedded sleeve is fixedly installed in an inner cavity of the back frame; a side wall of the pre-embedded sleeve is provided with several deadbolt grooves provided along a length direction of the pre-embedded sleeve; the armrest body is internally provided with a deadbolt switchable between an unlocked state and a locked state, and a transmission assembly driving the deadbolt to switch between the unlocked state and the locked state; in the unlocked state, the deadbolt is stored into the armrest body and comes out of a selected one of the deadbolt grooves; and in the locked state, the deadbolt at least partially extends out of the armrest body and is plugged into any of the deadbolt grooves; and when the deadbolt is inserted into the deadbolt groove, the armrest body and the back frame keep relatively fixed, wherein the transmission assembly comprises a transmission rod provided in an inner cavity of the armrest body; the transmission rod undergoes sliding connection along a length direction of the armrest body; a side wall of the armrest body is provided with a first notch communicated to the inner cavity of the armrest body; the deadbolt slides to plug into the first notch; the transmission rod is obliquely provided with a guide section; a bottom end of the guide section is tilted to one side of the first notch; the deadbolt is provided with a fastening groove fastened on an outer side of the guide section; and a side wall of the guide section abuts against an inner wall of the fastening groove.

2. The armrest installation structure according to claim 1, wherein the transmission assembly further comprises a first compression spring; a top end of the first compression spring is fixedly connected to a bottom end of the transmission rod; and a bottom end of the first compression spring is fixedly connected to the armrest body.

3. The armrest installation structure according to claim 2, wherein a fixed seat is fixedly installed in the inner cavity of the armrest body; the fixed seat is provided with a socket groove allowing insertion of a lower end of the transmission rod; and the bottom end of the first compression spring is fixed on a bottom wall of the socket groove.

4. The armrest installation structure according to claim 3, wherein the fixed seat is provided with a transversely-arranged sliding groove; the sliding groove is communicated to the socket groove; the deadbolt is installed in the sliding groove; and a side wall of the deadbolt is in sliding connection with an inner wall of the sliding groove.

5. The armrest installation structure according to claim 3, wherein a side wall of the fixed seat is provided with an inwardly sunken storage groove, which is internally in sliding connection with a transversely-arranged anti-detachment buckle; the storage groove is internally provided with a second compression spring, one end of which is fixedly connected to a side wall of the storage groove, and the other end of which is fixedly connected to the anti-detachment buckle; an end of the anti-detachment buckle extends out of the armrest body; and when the armrest body is at an upper limit position, an upper wall of the anti-detachment buckle abuts against a bottom wall of the pre-embedded sleeve.

6. The armrest installation structure according to claim 5, wherein the side wall of the pre-embedded sleeve is provided with an anti-detachment groove with an opening facing downward; and when the armrest body is at the upper limit position, the anti-detachment buckle is plugged into the anti-detachment groove, and an upper wall of the anti-detachment buckle abuts against an upper wall of the anti-detachment groove.

7. The armrest installation structure according to claim 6, wherein an outer wall of the back frame has a disassembly hole communicated to the inner cavity of the back frame; and the disassembly hole and the anti-detachment groove are located at the same height.

8. The armrest installation structure according to claim 1, wherein the transmission assembly further comprises a drive member pushing the transmission rod to slide along the armrest body; the drive member comprises a pushbutton switch, which comprises a pressing portion extending from outside of the armrest body, a pushing portion located in the inner cavity of the armrest body, and an articulated column located between the pressing portion and the pushing portion; the articulated column is articulated with the armrest body; and the pushing portion abuts against a top end of the transmission rod.

* * * * *